US006477734B1

(12) United States Patent
Gresser et al.

(10) Patent No.: US 6,477,734 B1
(45) Date of Patent: Nov. 12, 2002

(54) DIRT REMOVAL SYSTEM FOR A TEXTILE MACHINE

(75) Inventors: Götz Theodor Gresser, Winterthur; Olivier Wüst, Seuzach; Rolf Böhler, Schaffhausen; Christian Griesshammer, Winterthur, all of (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/701,081

(22) PCT Filed: May 26, 1999

(86) PCT No.: PCT/CH99/00227

§ 371 (c)(1),
(2), (4) Date: Jul. 9, 2001

(87) PCT Pub. No.: WO99/61688

PCT Pub. Date: Dec. 2, 1999

(30) Foreign Application Priority Data

May 26, 1998 (CH) ..... 1153/98
Jun. 17, 1998 (CH) ..... 1303/98

(51) Int. Cl.[7] ..... D01G 9/08; D01G 15/80

(52) U.S. Cl. ..... 15/309.1; 15/409; 19/98; 19/108

(58) Field of Search ..... 15/303, 306.1, 15/309.1, 409; 26/29 P; 19/98, 100–110

(56) References Cited

U.S. PATENT DOCUMENTS 3,078,496 A * 2/1963 Doran et al.
3,301,606 A * 1/1967 Bruno
4,079,483 A 3/1978 Hicks
4,092,764 A 6/1978 Thomas et al.
4,198,725 A 4/1980 Trützschler
4,314,387 A 2/1982 Löffler
4,353,149 A 10/1982 Demuth et al.
4,400,852 A 8/1983 Löffler
4,797,980 A 1/1989 Jagst
4,805,267 A 2/1989 Leifeld (List continued on next page.)

FOREIGN PATENT DOCUMENTS

DE 3331362 C1 1/1985
EP 366692 1/1989
EP 0387908 B1 9/1990
EP 0459565 A1 12/1991
EP 0848091 A1 6/1998

OTHER PUBLICATIONS

International Search Report dated Sep. 14, 1999.
English language Abstract of Japan for Application No. 05172611, Pub. No. 07011522.
English language Abstract for DE 33 31 362 C1, Derwent Info. Ltd. (c) 2002.
English language Abstract for EP 366 692, Derwent Info. Ltd. (c) 2002.
English language Abstract for EP 0 387 908 B1, Derwent Info. Ltd. (c) 2002.

*Primary Examiner*—Terrence R. Till
(74) *Attorney, Agent, or Firm*—Dority & Manning

(57) ABSTRACT

In a fiber-processing machine with a separating edge, in which both fibers as well as air are guided past the edge in a substantially predetermined conveying direction, air layers loaded with dirt particles or waste are deflected by means of the edge from the stream of fibers/air. The removal of dirt is aided at first by means of blast air.

52 Claims, 7 Drawing Sheets

U.S. PATENT DOCUMENTS

| | | | | |
|---|---|---|---|---|
| 4,972,552 | A | | 11/1990 | Graf |
| 5,031,278 | A | | 7/1991 | Demuth |
| 5,031,279 | A | | 7/1991 | Temburg |
| 5,033,165 | A | | 7/1991 | Temburg et al. |
| 5,075,930 | A | | 12/1991 | Carey et al. |
| 5,095,584 | A | | 3/1992 | Temburg |
| 5,142,742 | A | | 9/1992 | Erni et al. |
| 5,228,170 | A | | 7/1993 | Giuliani |
| 5,343,597 | A | | 9/1994 | Pinto et al. |
| 5,448,800 | A | | 9/1995 | Faas et al. |
| 5,490,300 | A | * | 2/1996 | Horn |
| 5,530,994 | A | | 7/1996 | Loeffler |
| 5,613,278 | A | | 3/1997 | Temburg |
| 5,884,360 | A | * | 3/1999 | Palffy |
| 6,145,166 | A | | 11/2000 | Waeber et al. |
| 6,185,787 | B1 | | 2/2001 | Waeber et al. |
| 6,212,737 | B1 | | 4/2001 | Faas |
| 6,219,885 | B1 | | 4/2001 | Faas et al. |

* cited by examiner

PRIOR ART 104
117
116
321
106
117
322
117
33
323
VL
108
VL
VL
+P
28
26

DIRT REMOVAL SYSTEM FOR A TEXTILE MACHINE

FIELD OF THE INVENTION

The invention relates to the improvement of dirt separating apparatuses, in particular, a dirt removal system for use in a textile machine such as in the blowroom or in the card of a spinning mill.

BACKGROUND OF THE INVENTION

It is current practice to provide devices with "sucked-off knives" both on the cylinder as well as revolving flat and fixed flat cards. These devices are capable of removing dirt particles from the processed material, whereas the fibers are further conveyed with the clothing of the cylinder. Casing segments suitable for this purpose have been described in EP-A-431 482 and in EP-A-366 918. A new arrangement for this purpose has been shown in our EP Application No. 978 106 95.3 which was published on Jun. 17, 1998 under the no. EP-A-848 091.

The attachment of knives to casing segments is also shown in U.S. Pat. No. 4,314,387 and 5,530,994, with the latter providing the introduction of an air stream between a segment and an element attached thereto. Similar air streams have been explained in EP-A-366 692 and EP-A-338 802, whereas EP-A-387 908 stresses the relevance of the air household for the cleaning effect. In all of these cases, the introduction of an air stream is seemingly only designed to improve the separation of dirt, with air turbulence being taken into account or even being desired. They also only deal with the zone upstream of the knife as seen in the direction of the fiber conveyance. CH-B-668 085 also deals with the design of a dirt separating apparatus. The knife and the vacuum chamber are to be provided with an integral arrangement, with the distance between the vacuum chamber and the knife blade to the cylinder being adjustable.

CH-B-668 085 shows in FIG. 2 a solution which is provided with a separating edge on a "knife blade." No statements are made in CH-B-668 085 about the air streams in the working gap between the blade and the cylinder. In an alternative embodiment (FIG. 4) which seems to be equivalent to the embodiment according to FIG. 2, the wall element comprising the separating edge is provided with a curvature which leads to a considerable enlargement of the working gap downstream of the separating edge.

The known systems are used not only for dirt separating devices in the carding machine, but also at other locations in the spinning mill, e.g., in cleaning machines (e.g., flock cleaners) which are provided with separating knives (e.g., according to the first figure of DE-A-44 41 254).

According to EP-A-810 309, a cleaning step is also provided for in the tuft feeder chute of the carding machine. EP-A-894 878 shows a suitable arrangement of a separating edge with a discharge means assigned to the edge.

The state of the art has thus been explained on the basis of "knives" (which are also known as "blades"), with a "knife" usually comprising a blade which is adjustable with respect to a rotating roller (e.g., card cylinder). It is also known to exercise such a function by an edge (also known as "separating" edge), with the edge being formed on an element which is not necessarily designed as an adjustable "knife." The invention can also be applied in such arrangements. In order to avoid cumbersome repetitions in the description, reference will be made hereinafter to an edge, with this term comprising the special form of "knife" and "blade."

The invention according to EP-A-848 091 (the "prior invention") is based on the finding that the air streams play an important role not only for the separation of dirt, but also in connection with the formation of neps. In connection with the latter, the production of turbulence is not desirable. Moreover, the region downstream of the edge is as important as the region upstream of the edge. These findings not only apply to dirt separating devices in the carding machine, but also to other locations within the spinning mill such as cleaning machines that are provided with separating edges. It is the object of the EP-A-848 091 invention to improve the air household downstream of the edge. The formation of neps in fiber-processing machines that is caused by air turbulences can be reduced. It is also possible to achieve an improvement in the separation of dirt per se.

The prior invention provides a fiber-processing machine with a separating edge. Both fibers as well as air are guided past the edge in a substantially predetermined direction of conveyance, and dirt particles are discharged in a selective manner by means of the edge from the stream of air and fibers. The invention is characterized in that at least one measure has been taken in order to influence the air streams in the zone downstream of the knife. The measure can be made in such a way that air turbulences downstream (in the conveying direction) of the edge are limited or even eliminated (to the highest possible extent). In other words, the highest possible laminary flow configuration is to be produced or maintained downstream of the edge. Alternatively, or additionally, the measure can be made in such a way that the air separated by the edge can be discharged substantially without any recirculation.

The measure preferably includes that air discharged by the edge is replaced at least partly by newly introduced air. The newly introduced air flows appropriately into the zone adjacent to the edge, e.g., within a distance of approx. 50 mm downstream of the edge and preferably within a distance of less than 20 mm. In one solution, the newly introduced air flows right behind the edge into the stream of air and fibers. The arrangement according to EP-A-848 091 can be provided in such a way that the effective cross section of the working gap downstream of the edge is provided with an extension. It is not possible to define the degree of extension in advance, e.g., when the position of the edge can be adjusted in the radial direction with respect to the cylinder.

According to the prior invention, means are therefore provided in order to allow the air to flow into the space downstream of the edge. The means can be arranged in such a way that air is allowed to flow in substantially over the entire working width, preferably as evenly as possible over the entire working width. The edge is preferably formed on an element which is suspended in the casing of the cylinder. The casing should be arranged in such a way that the production of the required air stream is enabled.

Preferably, the arrangement is self-adjusting concerning the incoming air quantity, meaning (for example) that it is not necessary to work with blower air. When the free cross section for the flow is adequately dimensioned for the air supply, the required air stream will rise as a result of the negative pressure in the space downstream of the edge.

EP-A-848 091 shows, particularly in FIG. 5, a solution with a separating edge which is provided adjacently in the direction of conveyance or flow with a guide surface. The relationship between the separating edge and the guide surface is variable (adjustable) in EP-A-848 091, because the guide surface is fixedly attached towards the cylinder, but the separating edge is adjustable in order to enable it to adjust its "immersion depth" into the stream of air/fibers.

Notice should be taken, however, that the conditions in the discharge are as sensitive as those in the working gap. On the one hand, it is necessary that the dirt be securely removed from the machine. On the other hand, the discharge should not impair the air household in the working gap per se, since the latter air household is relevant for the technological (separating) effect of the cleaning unit.

The complexity of this problem is also a function of the working width of the fiber-processing machine (of the cleaning unit). In conventional machine widths of approx. 1000 mm, suction for removing dirt has worked fine or at least satisfactorily. Larger width machines (e.g., up to 2000 mm in so-called carding machines), however, have been known to be used, and it has been proposed in EP-A-866 153 to increase the working width of the cotton card (and its tuft feeder chute) from 1000 mm to approx. 1300 to 1500 mm.

OBJECTS AND SUMMARY OF THE INVENTION

It is a principal object of the present invention to improve the air household in the discharge of dirt. It is also possible to achieve in this first aspect of the invention an improvement of the separating of dirt per se. The invention can serve to fulfill either one or the other or both of these purposes.

The invention provides in this first aspect a dirt separating device with means (e.g., an edge) for deflecting ("peeling off") dirt-loaded air from the stream of air/fibers to a dirt removal instrument or discharge, e.g., to an oblong conduit (extending over the working width). A device in accordance with the first aspect of the invention is characterized in that an air supply apparatus provides blast air to convey the dirt from the dirt removal instrument, e.g., the conduit.

The invention is provided for the particular, but non-exclusive, application in a machine which comprises a rotatable roller (cylinder or swift), with the stream of air/fibers flowing in a "working gap" between the circumference of the roller and a casing encompassing the same. An edge can be provided in the casing. The selectivity of the separation is then achieved in such a way that the roller is provided with a fiber-holding clothing, while the dirt particles, which are heavier than the fibers or have a higher flow resistance, are forced by the centrifugal force radially outwardly (against the casing). The working gap usually extends over the entire axial length (over the "working width") of the roller, and dirt is separated over the entire working width.

A machine according to the first aspect of the invention is characterized in that means are provided to introduce blast air for the conveyance of dirt into a dirt discharge.

The supply of blast air is preferably performed continuously, while the machine remains in operation. The quantity of blast air, the location of inflow, or the air speed during the inflow can be chosen in such a way that deposits in the conduit are prevented and the air household of the dirt separating device is not impaired by the blast air. The air conditions in the conduit can be chosen in such a way that the air flow in the conduit is produced merely by overpressure. In such a case, the flow is transferred at the end of the conduit to a system for further conveyance which operates by means of negative pressure.

Another object of the present invention, together with EP-A-848 091, is to provide a fiber-processing machine with a removal or separating edge, with both the fiber as well as the air being guided past the edge in a substantially predetermined direction of conveyance and dirt particles being removed from the stream of air and fibers by means of the edge. The edge is followed in the direction of flow by a flow guide surface. Means are provided in order to enable the setting of the immersion depth of the separating edge into the stream with the position of the guide surface, with respect to the stream, also being newly set when the immersion depth of the edge is adjusted.

The separating edge can be formed on an element, which is fastened to a further element that is provided with the guide surface. The fastening and the adjusting means are preferably provided in such a way that the separating edge and the guide surface maintain their respective positions during the setting.

An air introduction in accordance with EP-A-848 091 is preferably provided downstream of the guide surface.

The guide surface can be arranged as the casing of a working gap with the mutual positions of the edge and the guide surface being chosen in such a way that, downstream of the edge, the working gap need not expand at all or only marginally (e.g., not more than 0.5 mm, preferably not more than 0.3 mm). The arrangement can be such that no substantial drop in pressure is produced in the working gap downstream of the separating edge, which applies to any immersion depth of the separating edge.

A further object of the present invention is to provide a dirt separating device for the application in a stream of air/fibers in a machine of the blowroom or card room in a spinning mill comprising a separating edge and a flow guide element. The element can be arranged upstream of the edge in the direction of the flow of the machine. A discharge conduit can be formed by means of a first part of the conduit which is provided with the edge and a second part of the conduit which is provided with the flow guide element. The first and second parts of the conduit can form the discharge conduit either alone or jointly with other conduit parts, which discharge conduit is used in the machine to discharge air peeled off by the edge and material conveyed with the air transversally to the main direction of flow. The two parts can each be set individually with respect to the stream of air/fibers. Additional objects and advantages of the invention will be set forth in part in the following description, or may be obvious from the description, or may be learned through practice of the invention.

Embodiments of the aforementioned aspects of the invention are now described below by reference to the schematic drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
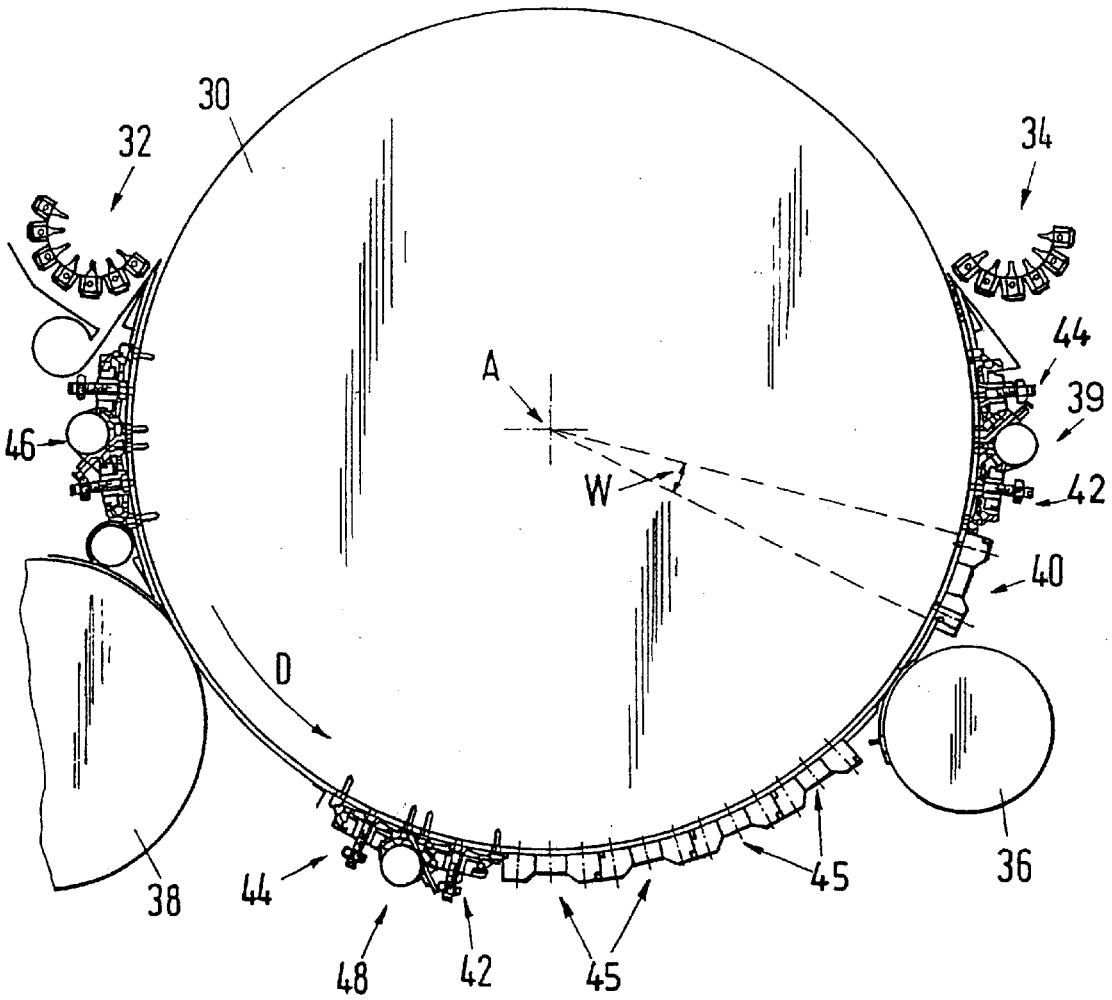
FIG. 1 shows a prior art figure from EP-A-848 091 (and EP-A-431 482)

FIG. 1 shows a schematic side view of the cylinder (the swift) 30 of a carding machine, the end parts 32, 34 of a revolving flat unit which defines the main carding zone, the licker-in 36 (also known as taker-in) as well as a doffer 38. The direction of rotation of the cylinder 30 about its axis A is indicated with arrow D.

In the pre-carding zone, between the licker-in 36 and the adjacent end 34 of the revolving flat unit, there are a dirt separating apparatus 39 and a casing segment 40, which is upstream of the same. The apparatus 39 comprises two casing segments 42, 44 which will be described below in closer detail. The post-carding zone, which is situated between the other end 32 of the revolving flat unit and the doffer 38, is provided with a dirt separating apparatus 46 which is exchangeable with apparatus 39 and therefore will not be described separately. Finally, in the bottom carding zone (between the doffer 38 and the licker-in 36) according to FIG. 1, there is a further dirt separating apparatus 48 and four casing segments 45. The segments are exchangeable with the segment 40. The apparatus 48 can also be replaced by two segments 45, but it can also (if retained) be formed according to the prior or the present invention.

Figure 2:
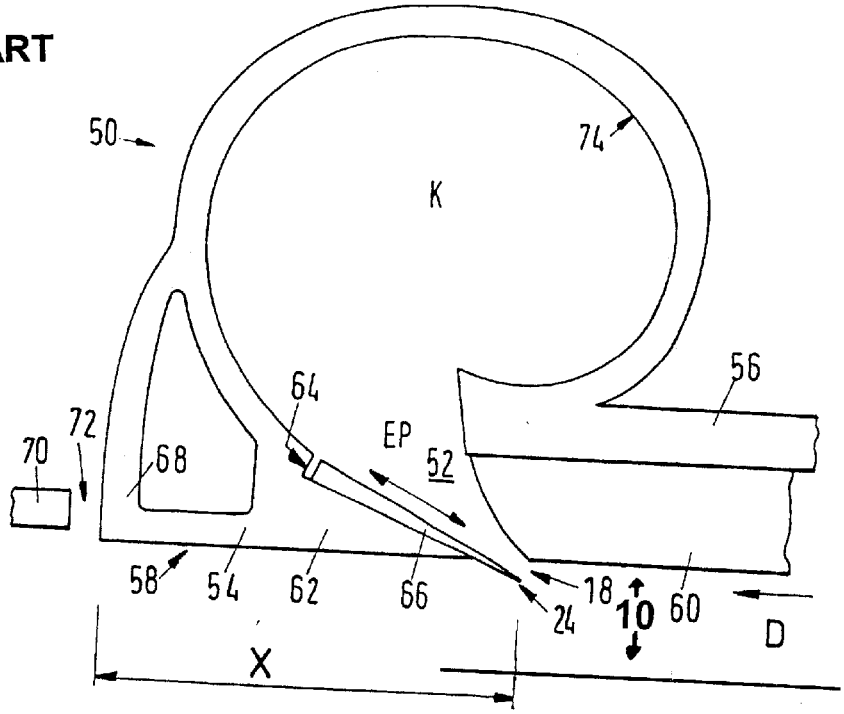
Fig.2 PRIOR ART
FIG. 2 shows a prior art figure illustrating a sectional view through a preferred arrangement according to EP-A-848 091.

The device in FIG. 2 is provided for the application on the jacket surface of the main cylinder of a carding machine, with the direction of rotation of the cylinder being indicated in FIG. 1 with the arrow D. The jacket surface carries a clothing which is not shown because it does not play any relevant role for the explanation and is well known to the person skilled in the art. A working gap is indicated with 10, with a separating gap 18 being provided in the casing and opening into the working gap 10. The separating gap 18 is covered by means of a cap (as will be explained below in closer detail) which is connected at one end (not shown in FIG. 1) to a suitable suction apparatus in order to discharge waste separated through gap 18.

The device is provided with a knife 66 which is provided with a separating edge 24 projecting into the working gap 10. The knife is fastened, for example, by screws (not shown) to an element 62. The element 62 is provided with a bearing surface for a respective surface on knife 66. After loosening the fastening screws, the knife can be displaced in the directions as indicated with the double arrow EP, with the bearing surfaces sliding along one another. The position of the separating edge 24 towards the jacket surface of the cylinder (or the clothing which is not shown herein) can be changed. The knife 66 also extends over the fall working width. It is important in this respect that the position of the separating edge towards the jacket surface is set or maintained as evenly as possible over the width.

The stream of fibers/air in the working gap 10 upstream of the edge 24 is substantially influenced by the circumferential speed and the "surface roughness" of the roller (cylinder). The latter parameter is naturally determined by the properties of the clothing (not shown). The set position (the "immersion depth") of the separating edge 24 towards the casing substantially determines the share of the arriving stream of fibers/air which is "peeled off" by the knife 66, deflected into the separating gap 18, and thus removed from the working gap 10. The adjustability is important because the share to be separated depends on the fiber material to be processed and cannot be determined in advance (during the design of the machine). The discharged share should be selected in such a way that the "peeled-off" air layers convey a relatively large amount of dirt particles (and optionally also short fibers) and as few batch fibers as possible.

The technology or the functional principle of dirt separation can be chosen at will from the known possibilities. Various devices for application in the card can be found for example in EP-A-387 908, EP-A-366 692, U.S. Pat. No. 4,400,852, U.S. Pat. No. 5,448,800, EP-A-520 958, DE-A-39 02 202, U.S. Pat. No. 4,805,267, DE-A-33 31 362, U.S. Pat. Nos. 4,797,980 and 5,031,279. The following describes the elements for the removal instrument for removing the separated dirt from the working area of the machine.

The cap is formed in this case by a profile element 50 (e.g., made of hard anodized aluminum or of steel). The profile element 50 extends over the entire working width and is provided with a longitudinal duct K as well as with an opening 52 which is used for forming the separating gap 18, with the gap 18 representing the orifice of opening 52 to the working gap 10. The profile element is also provided with two casing elements 54, 56, whereof the one part 54 is provided with a guide surface 58 which together with the cylinder delimits the working gap 10. The second part 56 is used as a carrier for the guide element 60 which is exchangeably fastened to the carrier in order to stand opposite of the cylinder or clothing after the assembly.

The tapering wall element 62 between the surface 58 and the opening 52 is provided with a recess 64 which receives the knife blade 66. The air, which is deflected by the blade 66 from the working gap, is replaced by new air, namely at the end of the guide surface 58 which is remote from the edge 24. An air inlet opening 72 is provided between the wall 68 of the profile element 50 and the adjacent casing element 70, which inlet opening connects the working gap with the environment outside of the casing during operation. The distance X of the opening 72 from the edge 24 is preferably less than 50 mm. The opening 72 is preferably present in the form of a "slot", so that the opening extends over the entire working width. This, however, does not represent any relevant feature of the invention.

The guide surface 58 should be arranged and set close to the beater circle of the cylinder in such a way that no relevant turbulences are produced in the stream of fibers/air remaining in the working gap downstream of edge 24. For this purpose, the surface 58 can preferably be set so closely towards the cylinder that no relevant enlargement of the stream after the edge 24 is required. As a result, a drop in pressure in the working gap at the edge 24 or downstream thereof can be substantially prevented. By maintaining suitable pressure conditions at the edge 24, it is possible to prevent the recirculation of air from the opening 18 to the working gap 10. It is also possible to set the share of the stream of fibers/air to be "peeled off" more precisely by the adjustment of the blade 66. Without this measure, an unfavorable air circulation may be produced within the opening 52 and dirt particles will reach the working gap again. This embodiment allows a very narrow setting of the edge 24 or the surface 58 respectively towards the tips of the clothing of the cylinder. The distance of the edge 24 from the clothing tips can be in the range of 0.25 to 0.5 mm for example, and the distance of the surface 58 from the clothing tips can be 0.8 mm for example.

Figure 3:
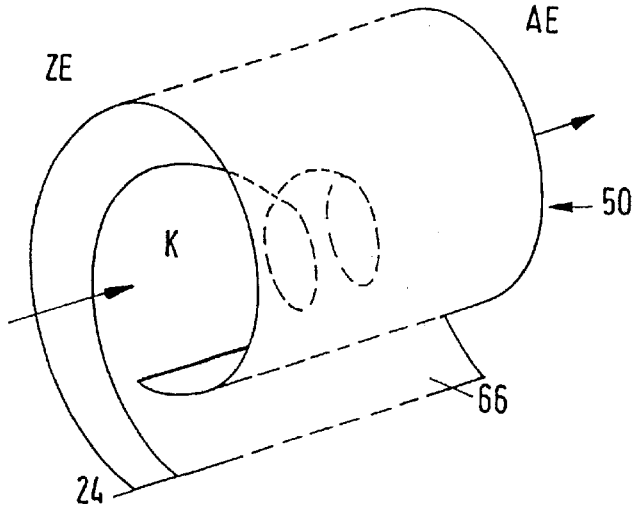
Fig.3 PRIOR ART
FIG. 3 shows a prior art figure illustrating a schematic isometric representation of the preferred suction in a device in accordance with FIG. 2.

According to the schematic representation in FIG. 3, the interior surface 74 of the profile element 50 is arranged in such a way that the discharged air enters the longitudinal conduit K approximately tangentially. At first following the interior surface 74, the discharged air is guided thereafter to the zone about the center of the longitudinal conduit. This path leads to a spiral movement of the air, including the entrained dirt or fibers. EP-A-848 091 proposes a suction which is preferably performed from the middle region at an end AE (FIG. 3) of conduit K. Also according to EP-A-848 091, air is introduced in conduit K in the middle region at the other end ZE. This introduction of air allows maintaining approximately constant receiving conditions at the separating gap 18 over the entire working width. EP-A-848 091 does not make any statements about the type of the air supply. The attraction of air from the ambient environment by negative pressure in the conduit would be obvious, however.

Figure 5:
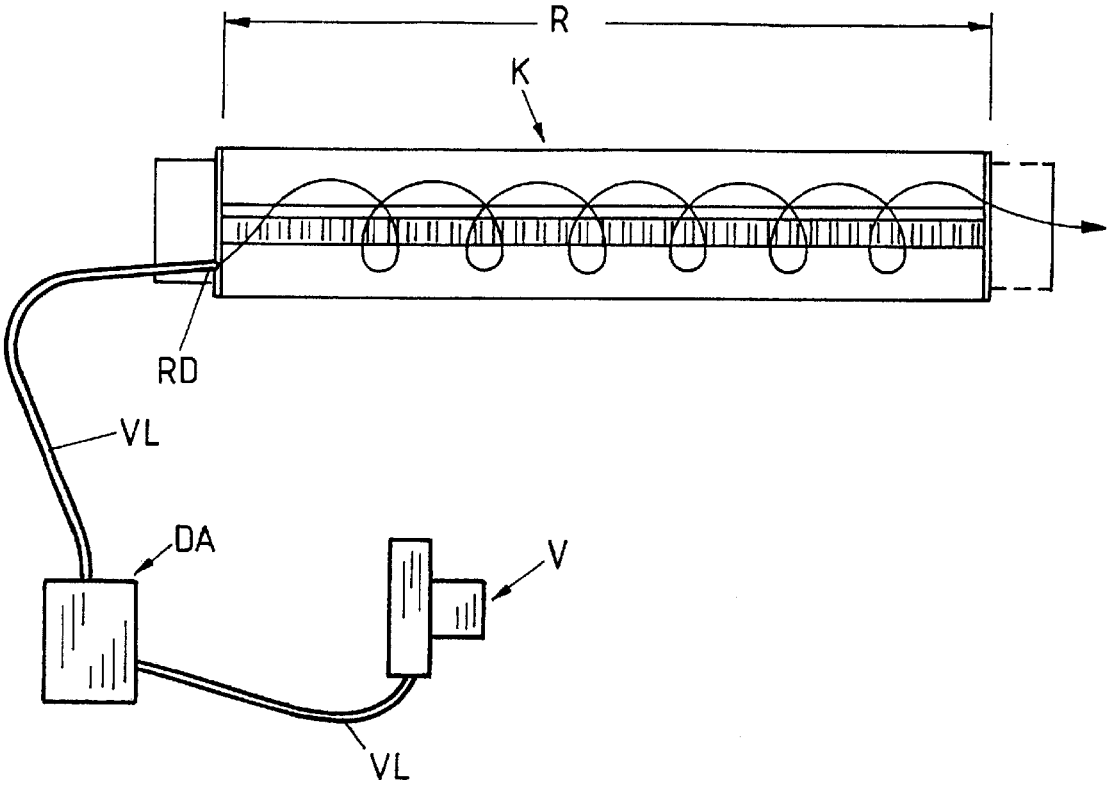
FIG. 5 shows a modification of the arrangement according to FIGS. 2 and 3 in order to form a new arrangement according to the first aspect of the present invention.

FIG. 5 schematically shows a modification of the arrangement according to FIGS. 2 and 3, with the conduit being shown from a direction transverse to its longitudinal axis and being marked again with the reference letter K. The effective length of conduit K (i.e., the length of the conduit part which must receive air from the working gap) corresponds to the working width of the machine and can be between 1000 and 2000 mm, preferably between 1000 and 1500 mm. The modification consists of the addition of the following elements:

a fan V;

a pressure compensation vessel DA;

a pipe nozzle RD; and connecting conduits VL.

Instead of drawing additional air from the ambient environment (as shown in FIG. 3), blast air is used in accordance with the present invention in order to ensure that the dirt separated by edge 24 is further conveyed from conduit K. The pipe nozzle RD is preferably directed at a slight incline into the conduit in order to support the spiral air flow.

The pipe nozzle RD is provided at its output with an inner width (a cross section of flow) which is relatively small as compared with the inner width (the cross section of flow) of the conduit K. The blast air thus flows into the conduit in the form of a directed jet. The cross section of flow of the nozzle preferably corresponds to approx. 12 to 25% of the conduit's cross section of flow.

An overpressure prevails in conduit K as compared with the ambient environment of the conduit. This overpressure defines the form of flow within the conduit. This form of flow should be chosen in such a way that the air peeled off at the separating edge can flow away from the separating edge without any disturbances. The required air quantity or the required air speed in conduit K partly depends on the rotational speed and the surface properties (of the clothing) of the cylinder 30. For a device in the carding machine (embodiment according to FIG. 5), the system is preferably designed in such a way that a total of 20 to 50 L per second can be introduced in order to obtain a flow speed in the conduit of between 5 m per sec. and 15 m per sec. For a device in the flock cleaning machine (embodiments according to FIGS. 4 and 6), the system is preferably designed in such a way that a total of 20 to 50 L per second can be introduced in order to obtain a flow speed in the conduit of between 5 m per sec. and 15 m per sec.

In the embodiment as exhibited in FIG. 5, air is injected from one side of the machine (at one end of conduit K). At the other side (at the other end of the conduit), suction is still performed, meaning that the discharge conduit is connected to a pneumatic conveying system which operates by means of negative pressure. The arrangement can be adjusted to the machine's design in that the suction concept is relevant for the choice of the "suction end" and the supply of compressed air is performed at the other end.

The invention is not limited to the introduction of blast air at one end of the conduit. Air could be blown into the middle of the conduit for example and sucked off at both ends, or the introduction of air could be distributed over different locations of the conduit length. At the "same" position in the longitudinal direction of the conduit, it would be possible to distribute several blast air supply openings about the longitudinal axis of the conduit. A conduit could also be provided in the form of a screen wall, with air flowing in over the entire length through the screen wall. This would require a rather complex design, however.

The supplied air quantity can be kept constant and even by means of the pressure compensation vessel DA. The periodic supply of compressed air in order to "blow out" the conduit is not excluded according to the invention. The constant supply is clearly preferred, however, because this allows maintaining constant pressure conditions in the conduit K, which simplifies ensuring predetermined air conditions in the opening 52 (FIG. 2). It can be ensured by means of this arrangement that no "process air" is sucked off from the fiber-air stream in the working gap 10. The air layer peeled off by edge 24 must naturally be received. The air flow at the roller (cylinder) remains principally unaffected by the discharge of the dirt.

The conduit K is efficiently flushed by the compressed air, so that the waste will not remain in the suction conduit. The saddling of fibers on the separating edge 24 (FIG. 2) is also reduced, which leads to an improvement of the separation and the composition of the waste (ratio between fibers and particles).

Figure 4A:
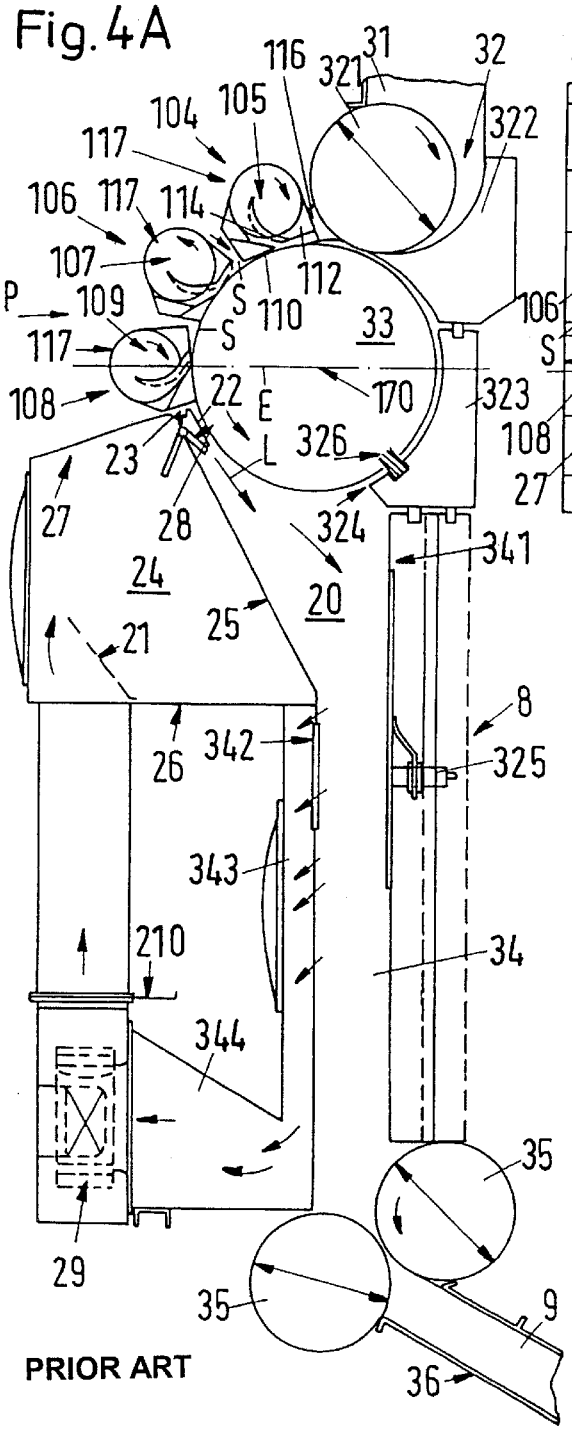
FIG. 4A and FIG. 4B show prior art copies of the FIGS. 3 and 3A of EP-A-894 878.

The invention is not limited to the application in the carding machine as will now be explained by reference to FIGS. 4 and 6. FIG. 4A shows a cross-sectional view of the most important elements of a new card tuft feeder chute 8 with a cleaning module according to EP-A-894 878, in particular the upper chute ("feed chute") 31, the lower chute ("reserve chute") 34 with conveying rollers 35, the material feed 32 with a feed roller 321 and a feed trough 322 and an opening roller 33 (preferably a needle roller). A filling level sensor 325 is also shown in FIG. 4A. The lap 9 supplied by the rollers 35 is further conveyed according to FIG. 4A to a connecting part 36 to the feed roller of the card (not shown).

Figure 4B:
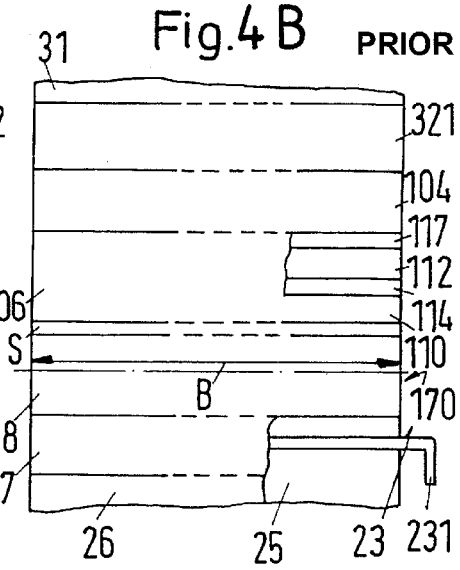
PRIOR ART Fig. 4B

The side view (FIG. 4B) shows the cleaning module in a view from the same chute in the direction of arrow P (FIG. 4A), with certain elements partly being cut off in FIG. 4B in order to allow the illustration of elements disposed under the same. The length of the roller 33 determines the working width B of the machine. This working width can be 1 m to 2 m, preferably 1 m to 1.5 m. The feed 32 must be able to supply flocks as evenly as possible over the working width B to the roller 33. Likewise, the cleaned material must be distributed as evenly as possible over the width of the lower chute 34. The rollers 321, 33 are rotatably mounted in the side walls (not shown) and held by the walls. The rotational axis of roller 33 is indicated with reference numeral 170. The directions of rotation are each indicated with arrows.

The opening roller 33 (needle roller), which is provided with a clothing, works here as a conveying roller which conveys the fiber material between the material feed 32 and the lap-forming device lower chute 34 and conveying rollers 35. As seen in the direction of rotation of the opening roller 33, the "transfer position" is situated where the roller 33 receives fiber material from the fiber tuft offered by the feed 32, slightly before the highest position on the conveying path. The fiber material is moved past three separating devices 104, 106, 108 in order to subsequently reach a deflection zone 20 at the upper end of the lower chute 34. The separating devices 104, 106, 108 are substantially arranged the same, so that the description of the device 104 can apply representatively for the other two devices 106, 108. Every separating device thus comprises a separating element 110 and a guide element 112, which is provided upstream of element 110 in the conveying direction. A separating gap 114 is situated between the guide element 112 and the separating element 110 which is associated with the same.

FIG. 4A shows that the first separating device 104 is virtually "immediately" adjacent to the feed roller 321. Only a guide rod 116 in the form of a tie-bar is located between the feed roller 321 and the first separating device 104. The guide rod guides the material grasped by the opening roller 33 into the working gap between the first guide element 112 and the conveying roller. There is only a minor distance S between a preceding device 104 and 106 and a downstream device 106 and 108. The forward edge of the last separating element 110 is therefore situated in a horizontal plane E which contains the rotational axis 170 of roller 33. This "geometry" is not mandatorily required. The "plane E" could also be displaced further in the rotational direction of roller 33, for example, in order to form an angle of approx 45° with the exhibited horizontal plane.

The cleaning is now performed at least partly "above" the roller 33, i.e., above the represented horizontal plane E. Gravity accordingly helps neither the separation nor the discharge of dirt. Each device 104, 106, 108, therefore, preferably comprises a separate dirt discharge which ensures that the material separated by the respective element 110 is removed from the zone of the conveying path. The material to be removed moves in the separating gap and in the downstream discharge opening in a direction which extends approximately tangential to the roller 33. Preferably, this material is deflected as soon as possible in a direction which extends approximately parallel to the rotational axis 170, but at least until it reaches either the one or the other side of the machine. Because gravity does not provide any help, the dirt discharge can be solved by means of an air stream. Every device 104, 106, 108 is equipped with a separate discharge conduit 117 which extends parallel to axis 170 over the working width. The individual conduits 117 can be connected on one side of the machine to a common suction line (not shown). The preferred connection is explained below in connection with FIG. 6.

It is possible with three separating devices 104, 106, 108 to achieve a sufficient degree of cleaning of the lap feed 9, even if (according to EP-A-810 309) no fine cleaning (with a nip feed) has been performed in the blowroom. As a result of the aforementioned displacement of the plane E in the conveying direction, it would be possible to gain the space for a fourth separating device. The fiber material, which still moves with the roller 33 after the cleaning (and which remains after the forward edge of the last separating element 110), therefore can be prepared for the deflection or the ejection into the lower chute or reserve chute 34. For this purpose, the material is at first guided close to the jacket surface of the clothed roller 33 by means of a guide surface 22. The material flow has the tendency to fly away tangentially from the roller 33 in a direction downwardly inclined. This inclination can be supported by an air stream L which mixes with the material flow after the guide surface 22 (as seen in the conveying direction) and flows further in the tangential direction. The air stream L flows past the tips of the roller clothing or even through the outermost peaks of said tips. A suitable means to determine the optimal direction of flow is explained below.

The stream of material is thus removed from the cylinder 33 to the highest possible extent and guided into the downwardly converging material deflection zone 20. In the case that the individual flocks should adhere to the clothing of the cylinder 33, the casing 323 of cylinder 33, which is situated opposite of the cleaning module, is provided with a knock-over or stripping edge 324 which can strip off any flocks that project from the clothing and deflect them into the zone 20. The casing 323 can be formed as a hollow profile such as by extrusion molding. The respective part is situated next to an adjacent trough part which forms the trough 322. The latter part can also be formed as a hollow profile.

The casing 323 can also be provided with an inwardly projecting brush 326, thus enabling the removal of individual fibers remaining in the clothing or flocks pressed into the clothing. The brush deflects the removed fibers or flocks into the zone 20 before the respective part of the clothed working surface is returned to the nip position of the feed 32.

An air stream L flows from a calming space 24 in a box 26, whereof the one wall 25 is arranged in an inclined way in order to form the one side of the material deflection zone 20. The side opposite of the zone 20 is formed in FIG. 4A by a perpendicular wall section 341 which is upwardly adjacent to the casing 323 and downwardly to a conveying roller 35. The wall section 341 is provided with an opening to receive the filling level sensor 325. It is not perforated, however, and can be provided with a seal against the casing 323. The air stream, which flows into the chute section 34, can therefore not escape on this chute side. The wall section 341, however, can be displaceable with respect to the casing 323 in order to enable the setting of the "depth" of the chute section 34 (in a horizontal direction rectangularly to the working width).

The uppermost edge of the wall 25 (as seen from axis 170) is disposed behind a sheet metal element which forms the guide surface 22. A swivel pin 23 can be attached to the wall edge which extends beyond the side walls of the machine and is provided outside of the walls with at least one adjusting lever 231. The axis 23 carries a wing 28 which together with the sheet metal element forms an inflow conduit for the air stream L. The sheet metal element per se is mounted fixedly with respect to cylinder 33. It is formed, for example, by a bent lip on the upper wall 27 of box 26. By swiveling the wing 28, it is possible to influence or optimize the width and the direction of the air stream L which is arranged as a "curtain." The lever 231 of swivel pin 23 can be actuated either manually or by a controlled actuating system. The wing may optionally be attached in a fixed way at a predetermined optimal position.

The air stream L is produced by a fan 29 and flows via a flap 21 into the calming space 24. The air for the air stream L could be obtained from the ambient environment. In the preferred solution, however, it is obtained as circulation air from the chute element 34, namely by holes (not shown in detail) in a wall section 342 that, in the embodiment according to FIG. 4A, extends perpendicularly downwardly from the lower edge of wall 25 and stands opposite of wall section 341. Numerous "perforated' walls are known for use in a lap-forming chute, so that a detailed description of the wall element 342 can be omitted. In the preferred embodiment, the perforated chute wall is formed as a screen wall. The wall can be composed of parts (lamellae). Irrespective of the manner in which the perforated wall is formed, the air escaping from the chute section 34 can be collected in a chamber 343 and be discharged downwardly until it is further conveyed to fan 29 by way of an intermediate element 344. The air stream flowing through the fiber mass in the chute section 34 is used for condensing the flocks accumulating therein. This action considerably improves the evenness of the lap formed between the wall sections 341, 342 and finally the lap 9 as supplied by the rollers 35.

The required air quantity can be determined empirically. The fan 29 is preferably driven at a constant speed with a motor (not shown). The required air quantity can be set by means of a slider 210 or the respective design of flap 21.

The cleaning module according to FIG. 4 is not only restricted to use in a card chute. The same solutions can be used for the arrangement of a "cleaning machine" which is to be used in a conventional blowroom line. When used in a fine cleaning unit, it will be possible to use a larger opening roller. Whereas the cylinder 33 can have a diameter in the range of 250 to 300 mm, a fine cleaning unit should be provided with an opening roller with a diameter of larger than 350 mm (e.g., approx. 400 mm). The working width can be in the range of 1 to 1.5 m, e.g., 1.2 m. It may be relevant in a fine cleaning unit to utilize the circumference (working surface) of the opening roller more intensively than is possible or necessary in a tuft feeder chute because the fine cleaning unit needs to cope with a higher throughput of material (currently 500 to 600 kg per hour). On the other hand, it is then not necessary to throw off the flock material because it is further conveyed by a known pneumatic conveying system to the next machine in the line. The "output" from the cleaning module to the conveying system therefore can be provided substantially below the feed which leave much space in the lower halves of the rollers for further separating devices. The separating devices in the lower half of the opening roller could also differ from the separating devices 104, 106, 108 because gravity will play a role again in the lower half of the rollers during the separation of material or during the removal of dirt.

Figures 6, 7:
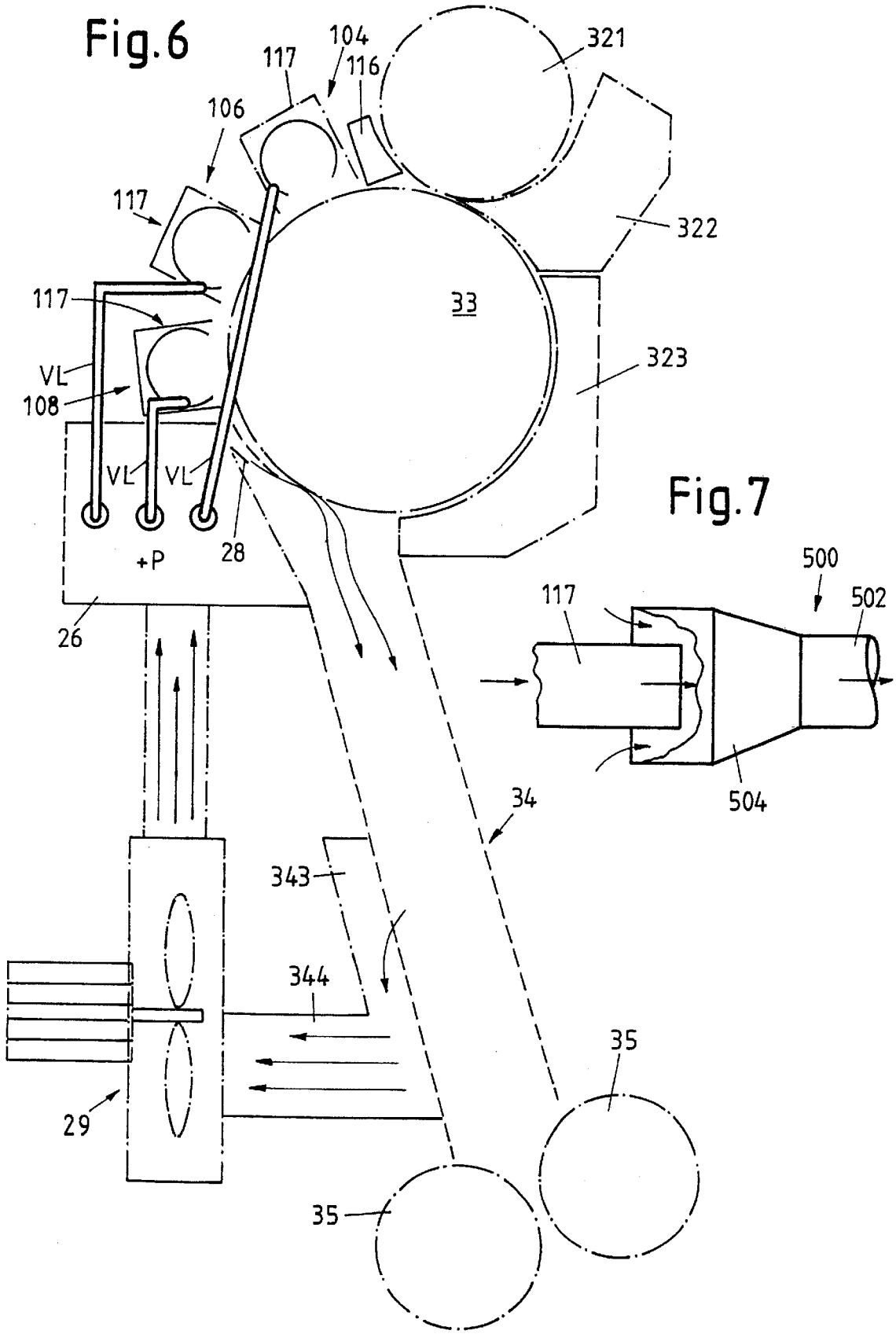
FIG. 6 shows a modification of the arrangement in accordance with FIGS. 4A and 4B in order to form a further arrangement according to the first aspect of the present invention.
FIG. 7 shows a possible modification of the arrangements according to FIG. 5 and FIG. 6.

FIG. 6 shows a modification of the module according to FIG. 4 in order to adapt it to the present invention, with the parts indicated with the same reference numeral being identical with the respective parts in FIG. 4 and not being explained again as a result. For the purpose of the adaptation, the connecting lines VL are guided from box 26 to the three discharge conduits 117 in order to use compressed air (with pressure+P) from box 26 for the discharge of dirt from the dirt separating devices 104, 106, 108. In this case, it is not even necessary to provide a special fan and pressure compensation vessel because these elements are present in the new chute anyway. It is possible, however, to nevertheless provide additional elements which are used for the discharge of dirt. The function of the compressed air in the discharge conduit is the same as has already been described for FIG. 5, which thus makes a repetition unnecessary. The arrangement of the dirt separating devices 104, 106, 108 in the vicinity of cylinder 33 is preferably chosen according to EP-A-894 877.

FIG. 7 shows an open transfer from a discharge conduit 117 to the suction means 500. The transfer could also include secondary air from the ambient environment which simplifies further conveyance. The suction conduit 502, therefore, is provided with an open funnel 504 at its end close to cylinder 33. The discharge conduit 117 extends into the open end of funnel 504. At the other end, the conduit 117 can be provided with a lid (closed) or left open.

The present invention is not limited to these examples. Currently, knives that are sucked off are also used on the licker-in of the card or in conventional cleaners (e.g., according to U.S. Pat. No. 5,033,165), which knives can be improved by means of a compressed air supply in the dirt removal system. The invention can also be used in other textile machines.

Figure 8A:
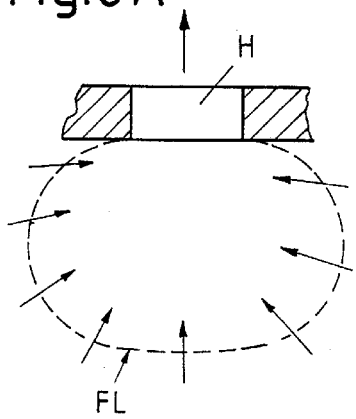
PRIOR ART Fig. 8A
FIG. 8 shows two diagrams (FIG. 8A and FIG. 8B) for explaining the achieved improvement.
Figure 8B:
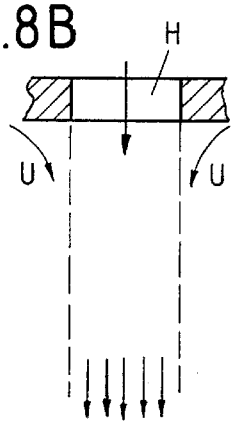

FIG. 8 shows by means of two diagrams 8A and 8B the difference in the action between a suction means and a compressed air introduction for the further conveyance of dirt. A suction means (FIG. 8A) spreads its effect in an open space over a spherical volume between the suction opening H and imaginary surface FL (indicated with the broken line) where an effect is to be produced (or measured). A compressed air jet (which is also indicated with a broken line, FIG. 8B) from the same opening H remains compact in the space at first and even pulls ambient air U towards itself. At a predetermined energetic expenditure, it is therefore possible to produce a better transport (conveying) effect over a predetermined (and in particular straight) path with a compressed air jet than with a suction means. The suction means (working by means of negative pressure) remains relatively favorable for the discharge over longer, geometrically complex paths defined by lines from the machine to the central collecting location.

FIG. 8B shows that the spiral air stream as shown in FIG. 5 or FIG. 3 is not pertinent for the invention. The air introduction could also be performed parallel to the longitudinal axis of the discharge conduit. FIG. 8B also shows that the use of a nozzle (with an inside clearance which is smaller than that of the discharge conduit) is also not pertinent for the invention. The inflow of compressed air can principally be formed over the entire width of the conduit.

The further figures deal with other aspects of the invention. As an introduction, it is possible to note that in most cases the separating edge 24 in an arrangement according to FIG. 2 is set considerably closer to the jacket surface 31 than is possible for the surface 58 which is opposite of the cylinder. This setup means that the working gap 10 expands in the radial direction in the zone downstream of the separating edge 24 to a degree which depends on the momentary setting of the knife 22. The working gap downstream of the separating edge therefore "lacks" the discharge share of the stream, with the remaining share having to expand in order to fill the expanded working gap. In the zone of the working gap which is adjacent to separating edge 24, a negative pressure exists which may draw slightly more air (charged with dirt particles) between the separating edge 24 and the jacket surface 31 than is actually desired. Moreover, the expanding air stream has a tendency towards the formation of turbulences at the separating edge 24 which leads to turbulences in the zone downstream of the separating edge 24. Such turbulences can lead to a "rolling together" or entwisting of fibers, which produces neps. Eddies can also be formed in the separating gap per se, which draws air with dirt particles back to the working gap. The arrangements according to EP-A-848 091 have led to improvements in this respect.

Figure 9:
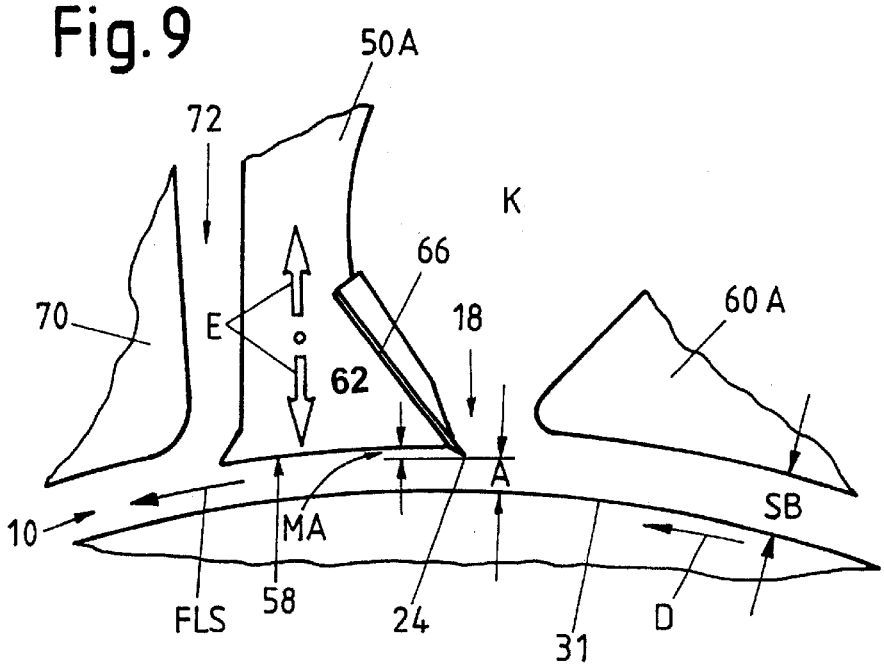
FIG. 9 shows a schematic representation of an embodiment of the present invention.

FIG. 9 now shows a further development of the arrangement according to FIG. 2, with the same reference numerals indicating the same parts. The knife blade 66 is fixedly attached to profile element 50A in this case. The fastening means are not shown. It is still necessary to be able to set the immersion depth of the edge 24 into the stream of air/fibers FLS. For the purpose of a predetermined working gap width SB upstream of the edge 24, the distance A of the edge 24 from the jacket surface 31 of the cylinder 30 should be variable in order to enable the selection of the deflected share of the stream FLS. The working gap width SB is predetermined by a fixedly mounted guide element 60A.

As in this case also, an air introduction gap 72 is provided downstream of the edge 24. However, it is only possible to move part 50A in order to enable the setting of the separating edge. This moveability is indicated schematically by the arrows E. This moveability means that not only blade 66 with edge 24 is moved with respect to the jacket surface 31, but also the guide surface 58. The predetermined relationship (the distance MA) between the separating edge 24 and the guide surface 58 is thus also maintained during and after the setting movement. This predetermined relationship which is determined by the fastening of blade 66 can be chosen in such a way that no relevant negative pressure is produced downstream of the edge 24.

Figure 10:
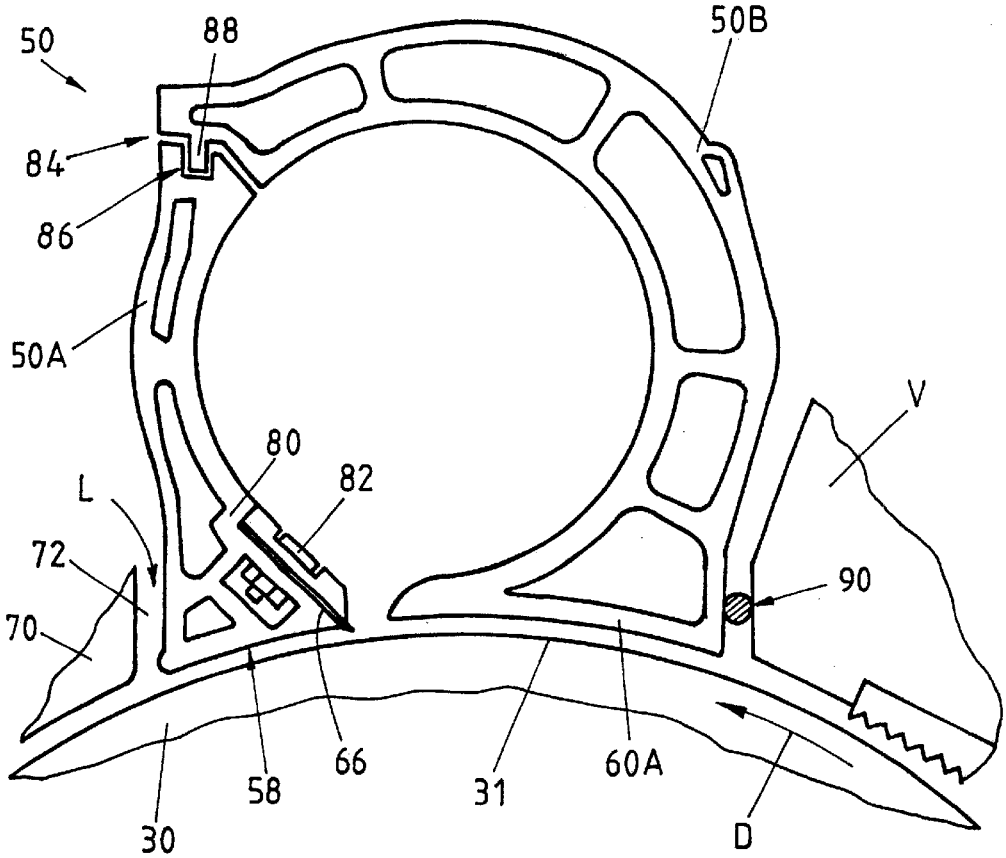
FIG. 10 shows a cross-sectional view through a possible embodiment in accordance with FIG. 9 for use in a cylinder of a carding machine.
Figure 12:
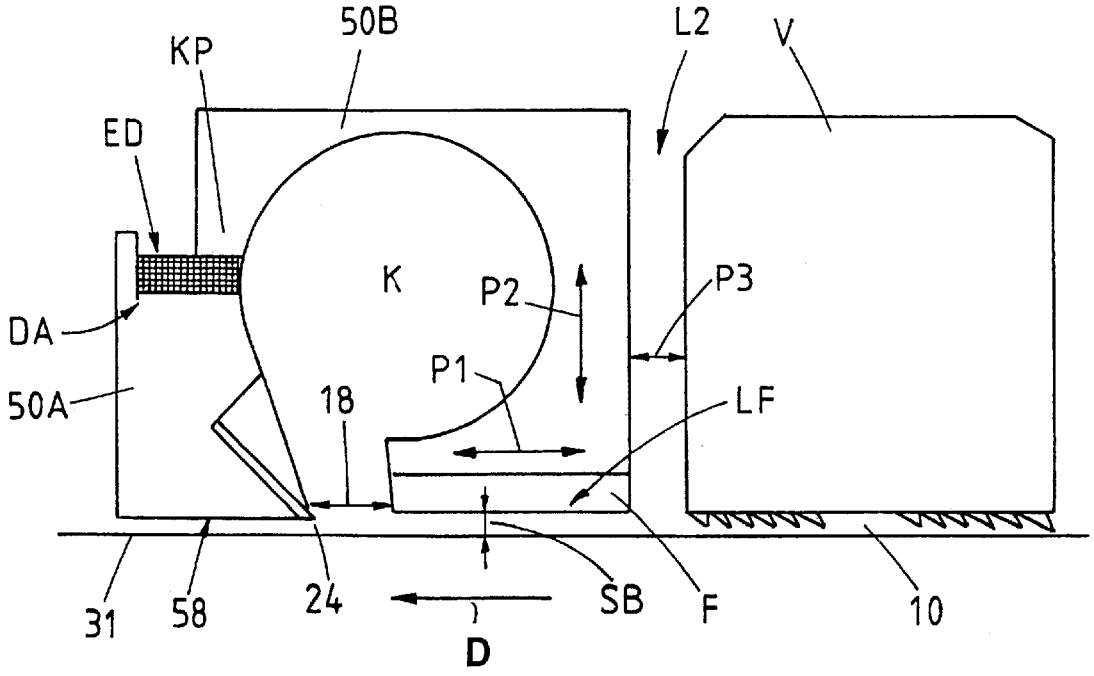
FIG. 12 schematically shows a partial section of the jacket surface of the cylinder with a device in accordance with an embodiment of the invention.

A possibility for realization is shown in FIG. 10. The discharge profile 50 comprises in this case two parts 50A, 50B. Separating element 50A is provided with the guide surface 58 and also with fastening noses 80 in order to cooperate with locking screws 82. These screws 82 and noses 80 represent the fastening means which fix blade 66 on separating element 50A. The second profile element 50B forms the guide element 60A. Element 50B is mounted adjacent to a casing segment V in the machine. A seal 90 is provided in this embodiment between the parts 50B and V, with an alternative being shown in FIG. 12. The two parts 50A, 50B jointly form a "closed" discharge profile in such a way that they are provided at location 84 with mutually engaging elements (namely with a groove 86 in element 50A and a respective projection 88 on element 50B). When element 50B is fixedly mounted with respect to cylinder 30, element 50A can be displaced linearly in order to change the immersion depth of edge 24 without brining the elements 86, 88 out of mutual engagement. The parts 86, 88 jointly form a labyrinth seal. An alternative is shown in FIG. 12.

The embodiment according to FIG. 10 also comprises a knife blade 66 which is formed separate from the profile element 50A, but is fastened thereto. The blade 66 can be made of hardened steel for example, whereas the profile 50 can be made of a light metal alloy. Such an arrangement is particularly advantageous in the pre-carding zone (above the licker-in 36, FIG. 1), because the device is provided for the processing of newly introduced (but not yet fully opened) fiber material. In the post-carding zone where material carded by the revolving flats is present, it is not mandatory to use a separate knife blade. The separating edge 24 can be provided directly on the profile element 50A.

The conduit elements can be produced by extrusion molding. The bipartite shape of the discharge conduit enables or facilitates working on the parts which are on the inside of the conduit (e.g., grinding or coating on its surface) or the replacement of the separating blade.

It is naturally not necessary to form the parts 50A, 50B as rigid, mutually engaging parts. It would also be possible for example to connect a flexible cover for the conduit K with two rigid parts. The wall element (62, FIG. 9) which carries the blade 66 (or is provided with the edge 24) should be provided with a sufficiently stable arrangement in order to ensure the set edge position and to hold the guide surface 58 in a predetermined relationship to edge 24.

The working gap width SB (FIG. 9) can be 0.6 mm to 1.5 mm (preferably 0.8 to 1.2 mm) for example. The distance A is 0.3 to 2 mm for example. The maximum radial expansion MA of the working gap downstream of the edge 24 is approx. 0.5 mm, preferably 0.3 mm. This "expansion" can be reduced to zero, however. It is defined in any case by the fastening of the knife blade 66 on profile part 50A.

Figure 11:
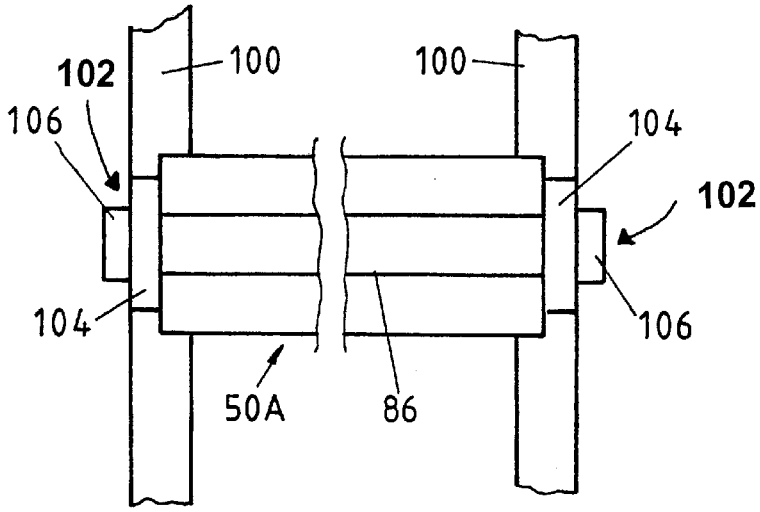
FIG. 11 schematically shows an arrangement for setting the elements in accordance with FIG. 10.

An adjusting means for adjusting the immersion depth of the edge 24 is schematically shown in FIG. 11. The profile element 50A extends over the working width of the carding machine between two so-called bends 100 which are mounted in the card frame. These bends 100 per se are adjustable towards the jacket surface of cylinder 30. They also carry the profile elements 50B, which are not shown in FIG. 11 because they can be attached fixedly on the bends 100. The working width gap SB is therefore determined by the setting of the bends 100. The profile element 50A must be adjustable towards the bend 100 in order to enable the setting of the immersion depth.

The setting could also be performed by an actuatable adjusting mechanism. Every bend 100 could bear a fixing device 102 (FIG. 11), for example, whereof the one part 104 is fixedly arranged on the respective bend 100 and the other part 106 is arranged movably. The part 106 could comprise an eccentric or an adjusting screw for example. The part 106 engages into the respective end of the profile part 50A and forms a movable stop, so that during the movement of the part 106, the part 50A moves or is moved respectively. The parts 106 are displaceable in radial directions with respect to cylinder 30, so that the profile part 50A performs finely controlled movements in these directions too.

In the preferred embodiment, however, the desired setting is effectively chosen by the respective arrangement of the fixing device for part 50A, with the part 50A assuming the respective setting during the mounting. Such a solution can be realized by a fixing device, which provides the insertion or removal of spacer elements, with part 50A being preferably pressed by spring assemblies against a stop formed by spacer elements. Such a solution also enables a simple assembly by fastening part 50A first in the desired position (with the required setting towards the cylinder), whereupon the part 50B can be attached during the production of the labyrinth seal. For the same reasons, it is relatively simple to disassemble and reassemble the module for maintenance purposes. Finally, the arrangement is also cost-effective from a production point of view because the two parts 50A, 50B can principally be produced by means of extruders. The later interior side of the conduit K is still accessible for any required later working (e.g., the coating of the interior or the adjusting of the fastening means for the knife blade 66).

This aspect of the invention is not limited to the details of the embodiment according to FIGS. 9 and 10. The separating position in the discharge profile 50 can be provided at another location in the circumference of the profile 50. The device can also be used at other locations in blowroom machines or carding machines, e.g., in a licker-in, particularly when several licker-ins are provided.

The schematic illustration in FIG. 12 thus represents an alternative embodiment of the invention. The reference numerals of FIG. 12 are therefore substantially identical to the reference numerals of FIGS. 9 and 10, as a result of which the two conduit parts 50A, 50B which form the conduit K, the jacket surface 31 of the cylinder, the direction of rotation D of the cylinder, the edge 24, the working gap 10, the distance SB, the separating gap 18 and the upstream working element V are indicated again. The new aspect in FIG. 12 is an air supply opening L2 between the element V and the part 50B, i.e., the gap between these parts is left open (unsealed, cf. FIG. 10). This new aspect allows air to flow into the working gap 10 via the supply opening L2. A further new aspect is an elastic sealing element ED between the two conduit parts 50A, 50B. This element ED is seated in a receiver DA on part 50A, with a contact section KP of part 50B being pressed strongly against the seal during the mounting in the carding machine (not shown). The conduit part 50B is also provided in the example according to FIG. 12 with an exchangeable base F, which defines a preseparation guide surface LF resulting in the distance SB with the cylinder jacket surface 31. The double arrows P1, P2 and P3 schematically show three additional settings which are enabled by the new arrangement according to FIG. 12 and are each described below in detail. It is assumed that the conduit Part 50A can also be set (as has already been described) with respect to the jacket surface of the cylinder. The elastic seal ED merely shows a possible alternative to the labyrinth seal according to FIG. 10. The effects which will be described below can also be achieved with other seals, in particular the labyrinth seal.

It is provided for according to DE-A-39 02 204 to apply technologically active parts of a dirt separating apparatus individually on a common carrier in order to enable the individual adjustability and thus optimizing capability of the technological effect. In contrast to this, "carrier parts" (in FIG. 12 the parts 50A and 50B) are arranged adjustably with respect to one another according to the present invention in order to enable the optimization of the technology.

A particularly important setting point is the width of the separating gap 18, i.e., the distance (which is also indicated with the double arrow) between the edge 24 and the base F. This width can also be influenced by the adjusting movements of the conduit part 50B which are indicated with the arrow P1. It is assumed for the time being that the conduit part 50A is to remain fixedly arranged with respect to the cylinder. The sealing element ED and its receiver DA are dimensioned so generously that the intended movements P1 can be performed without impairing the sealing effect. It is therefore clear that a respective technological effect could be achieved by an adjustment of the conduit part 50A in the circumferential direction of the cylinder.

If the conduit part 50B is adjusted in order to influence the width of the gap 18, the width of the air supply opening L2 changes simultaneously, as is indicated with the arrow P3. In this way, the air supply quantity upstream of gap 18 can be influenced. The supplied scavenging air is removed at least to a major part through the immediately adjacent separating gap 18 from the working gap 10. It can also play a role in the conveyance of the dirt particles, however.

The distance SB can also be influenced by the adjustment of the conduit part 50B in the arrow directions P2. This adjustment requires either maintaining the sealing effect on the element ED despite the possible decrease of the pressing pressure between the contact section KP and the receiver DA or the replacement of the element ED by a seal whose thickness is adjusted. The labyrinth seal according to FIG. 10 offers more freedom in this respect.

Figure 13:
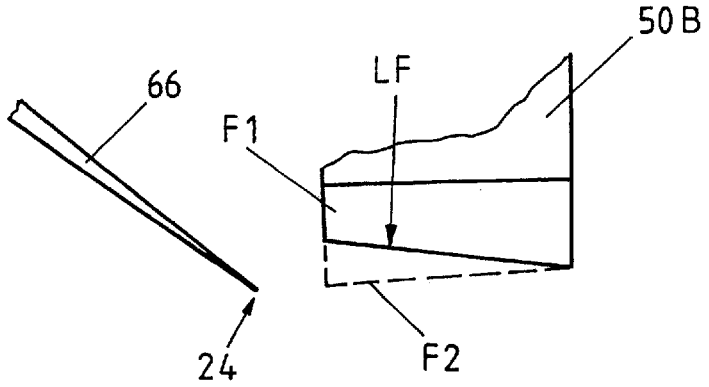
FIG. 13 shows a modification of the arrangement according to FIG. 12.

A similar effect can be achieved in principle by exchanging the base section F, e.g., by replacing the same with a section with a larger thickness. The exchange of the base also allows optimizing further technological parameters such as the flow profile in the working gap 10. This effect is shown in the diagram in FIG. 13 where the blade 66 with the edge 24 is used as a "reference." The cross section of the base F can now be changed when replacing the base section. FIG. 13 shows with the unbroken lines a first base F1 with a guide surface LF which leads to a widening of the working gap 10 in the direction towards the edge 24. The broken lines, on the other hand, show a base F2 which does not allow any expansion of the working gap 10 in the direction towards the edge. The flow speed in the working gap will be higher for a given air quantity in this gap when base F2 is used. It is necessary, however, to deflect air in a relatively strong way from the stream of air/fibers FLS into the separating gap 18. It is also possible to change the material or the surface quality of the base section F during the replacement, thus enabling the base to be adapted to different processed fiber materials (e.g., chemical fibers, cotton fibers, rayon-type fibers) and/or to the mean staple length of the processed fibers.

The base section can also be provided with a "structured" surface, meaning that it can be provided for example with grooves (as seen in the direction of flow) having a curved or angular cross section. The base section could be provided in particular with a guide element according to EP-A-388791.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. An apparatus for removing unwanted matter from a material flow within a fiber-processing machine, said apparatus comprising:

at least one adjustable separating device, which is in communication with a stream of air and material flowing within a working gap of said fiber-processing machine, said separating device extending the working width of said fiber-processing machine and deflecting air containing dirt and waste from said material flow;

a removal instrument operably disposed to said separating device, said removal instrument conducting dirt and waste away from said working gap of said fiber-processing machine; and at least one air supply apparatus integral to said removal instrument, said air supply apparatus introducing a blast of air into said removal instrument to further remove said dirt and waste from said working gap of said fiber-processing machine and prevent reintroduction of said dirt and waste into said working gap of said fiber-processing machine.

2. The apparatus as in claim 1, further comprising a rotatable cylinder to which said separating device is operably disposed, said rotatable cylinder extending the working width of said fiber-processing machine and creating said stream of air and material within said working gap.

3. The apparatus as in claim 2, wherein said separating device further comprises a separating edge, which penetrates said stream of air and material flowing within said working gap of said fiber-processing machine and deflects air containing dirt and waste from said material flow.

4. The apparatus as in claim 3, wherein said separating device further comprises a first guide surface integrally disposed upstream of said separating edge, said first guide surface guiding said stream of air and material towards said separating edge.

5. The apparatus as in claim 2, wherein said removal instrument further comprises a profile element extending the working width of said fiber-process machine, said profile element defining a discharge conduit through which said removed dirt and waste is conveyed and to which said air supply apparatus is operably disposed.

6. The apparatus as in claim 5, further comprising a guide element possessing said first guide surface disposed upstream from said separating device in a direction of flow of said stream of air and material, said guide element adjustable so as to adjust a width of said working gap preceding said separating device.

7. The apparatus as in claim 6, wherein said guide element defines a part of said profile element.

8. The apparatus as in claim 7, wherein said profile element further comprises a separating element to which said separating device is integrally disposed, said separating element movably linked to said guide element.

9. The apparatus as in claim 8, wherein said separating element further comprises said second guide surface.

10. The apparatus as in claim 9, wherein a setting mechanism operably adjusts said guide element constantly maintaining the mutual positions of said separating device, said second guide surface and said guide element relative to one another.

11. The apparatus as in claim 10, wherein said setting mechanism permits the setting of said immersion depth of said separating device into said stream of air and material, while constantly maintaining the mutual positions of said separating device and said second guide surface relative to each other without changing the position of said guide element.

12. The apparatus as in claim 5, wherein said air supply apparatus further comprises a nozzle operably disposed to said discharge conduit defined by said profile element.

13. The apparatus as in claim 5, wherein multiple air supply apparatuses are operably disposed at different positions to said discharge conduit defined by said profile element.

14. The apparatus as in claim 5, wherein said removal instrument further comprises a suction apparatus operably linked to said discharge conduit defined by said profile element, said suction apparatus retrieving dirt and waste conveyed by said blast of air from said air supply apparatus.

15. The apparatus as in claim 14, wherein said air supply apparatus is operably disposed at one end of said discharge conduit defined by said profile element and said suction apparatus is operably linked to an opposing end of said discharge conduit defined by said profile element.

16. The apparatus as in claim 5, wherein said blast of air from said air supply apparatus creates a spiral air flow through said discharge conduit formed by said profile element.

17. The apparatus as in claim 5, wherein said air supply apparatus further comprises a fan to produce said blast of air.

18. The apparatus as in claim 5, wherein said air supply apparatus further comprises a compressed air vessel interposed between said fan and said discharge conduit formed by said profile element.

19. The apparatus as in claim 5, wherein said blast of air from said air supply apparatus is introduced into said discharge conduit defined by said profile element in a manner that maintains air flow conditions within said discharge conduit substantially constant over time.

20. The apparatus as in claim 2, further comprising a second guide surface operably disposed downstream of said separating device to prevent pressure loss and turbulent flow in said stream of air and material flowing within said working gap of said fiber-processing machine downstream of said separating device.

21. The apparatus as in claim 20, further comprising a setting mechanism in communication with said separating device and said second guide surface enabling the setting of an immersion depth of said separating device into said stream of air and material to deflect dirt and waste from said stream, while constantly maintaining the mutual positions of said separating device and said second guide surface relative to one another.

22. The apparatus as in claim 2, wherein said blast of air from said air supply apparatus is a directed jet.

23. The apparatus as in claim 2, wherein said rotatable cylinder of said fiber-processing machine is a main cylinder of a carding machine.

24. The apparatus as in claim 2, wherein said rotatable cylinder of said fiber-processing machine is an opening roller of a tuft feeder chute of a carding machine.

25. The apparatus as in claim 2, wherein said fiber-processing machine is a flock cleaner.

26. An apparatus for removing dirt and waste from a fiber/air stream flowing in a working gap in a fiber-processing machine, said apparatus comprising:

at least one adjustable separating edge, which penetrates said fiber/air stream, defining an immersion depth within a working gap of said fiber-processing machine, said edge extending the working width of said fiber-processing machine and deflecting air containing dirt and waste from said material flow;

a flow guide surface operably disposed downstream of said separating edge to prevent pressure loss and turbulent flow in said fiber/air stream downstream of said edge;

a removal instrument operably disposed to said separating edge, said removal instrument conducting dirt and waste transversally away from said working gap of said fiber-processing machine; and a setting mechanism in communication with said separating edge and said flow guide surface enabling the setting of said immersion depth of said separating edge into said fiber/air stream, while constantly maintaining the mutual positions of said separating edge and said flow guide surface relative to one another.

27. The apparatus as in claim 26, further comprising a rotatable cylinder to which said separating edge and said flow guide surface are operably disposed, said rotatable cylinder extending the working width of said fiber-processing machine and creating said stream of air and material within said working gap.

28. The apparatus as in claim 27, wherein said removal instrument further comprises a profile element extending the working width of said fiber-process machine, said profile element defining a discharge conduit through which said removed dirt and waste is conveyed.

29. The apparatus as in claim 28, wherein said profile element further comprises a wall element integral to said flow guide surface.

30. The apparatus as in claim 29, wherein said casing element and said wall element define an air inlet opening downstream of said separating edge, said air inlet opening allowing air to flow into said working gap downstream of said separating edge.

31. The apparatus as in claim 28, further comprising a one guide element disposed upstream from said separating edge in a direction of flow of the fiber/air stream, said guide element adjustable so as to adjust a width of said working gap preceding said separating edge.

32. The apparatus as in claim 31, wherein said guide element defines a part of said profile element.

33. The apparatus as in claim 32, wherein said profile element further comprises a separating element to which said separating edge and said flow guide surface is integrally disposed, said separating element movably linked to said guiding element.

34. The apparatus as in claim 33, wherein said setting mechanism operably adjusts said guide element constantly maintaining the mutual positions of said separating edge, said flow guide surface and said guide element relative to one another.

35. The apparatus as in claim 34, wherein said setting mechanism permits the setting of said immersion depth of said separating edge into said fiber/air stream, while constantly maintaining the mutual positions of said separating edge and said flow guide surface relative to each other without changing the position of said guide element.

36. The apparatus as in claim 28, wherein said removal instrument further comprises a suction apparatus operably linked to said discharge conduit defined by said profile element.

37. The apparatus as in claim 36, wherein at least one air supply apparatus integral to said profile element and working in communication with said suction apparatus.

38. The apparatus as in claim 27, wherein a casing element encompasses said rotatable cylinder, and said flow guide surface forming a part of said casing element.

39. The apparatus as in claim 26, wherein said working gap undergoes negligible expansion downstream of said separating edge.

40. The apparatus as in claim 26, further comprising at least one air supply apparatus integral to said removal instrument, said air supply apparatus introducing a blast of air into said removal instrument to further remove said dirt and waste from said working gap of said fiber-processing machine and prevent reintroduction of said dirt and waste into said working gap of said fiber-processing machine.

41. An apparatus for removing dirt and waste from a fiber/air stream flowing in a working gap in a fiber-processing machine, said apparatus comprising:

at least one adjustable separating device, which is in communication with a stream of air and material flowing within a working gap of said fiber-processing machine, said separating device extending the working width of said fiber-processing machine and deflecting air containing dirt and waste from said-material flow;

a flow guide surface operably disposed downstream of said separating edge to prevent pressure loss and turbulent flow in said fiber/air stream downstream of said edge;

a guide element operably disposed upstream of said separating edge to allow adjustment of a width of said working gap preceding said separating device;

an adjustable first conduit element to which said separating device and said flow guide surface is operably disposed; and an adjustable second conduit element to which said guide element is operably disposed, said second conduit element positioned upstream from said first conduit element and movably linked to said first conduit element in a manner in which said first and second conduit elements operably define a conduit through which dirt and waste are conducted transversally as to said fiber/air stream away from said working gap of said fiber-processing machine and allow movement of said separating device and said guide element relative to one another.

42. The apparatus as in claim 41, wherein only one conduit element defines said conduit through which said dirt and waste are conducted away from said working gap of said fiber-processing machine.

43. The apparatus as in claim 41, wherein a seal operably links said conduit elements, said seal allowing the relative movements of said conduit elements.

44. The apparatus as in claim 41, further comprising at least one air supply apparatus integral to said conduit defined by said first and second conduit elements, said air supply apparatus introducing a blast of air into said conduit to further remove said dirt and waste from said working gap of said fiber-processing machine.

45. The apparatus as in claim 41, further comprising a suction apparatus operably linked to said conduit defined by said first and second conduit element.

46. The apparatus as in claim 45, wherein at least one air supply apparatus integral to said conduit defined by said first and second conduit element works in communication with said suction apparatus.

47. The apparatus as in claim 41, further comprising a setting mechanism in communication with said first conduit element and said second conduit element enabling the setting of said immersion depth of said separating device into said fiber/air stream, while constantly maintaining the mutual positions of said separating device and said flow guide surface relative to one another.

48. The apparatus as in claim 47, wherein said setting mechanism operably adjusts said first conduit element and said second conduit element constantly maintaining the mutual positions of said separating device, said flow guide surface and said guide element relative to one another.

49. The apparatus as in claim 48, wherein said setting mechanism permits the setting of the immersion depth of said separating device into said fiber/air stream, while constantly maintaining the mutual positions of said separating device and said flow guide surface relative to each other without changing the position of said guide element.

50. The apparatus as in claim 41, wherein said first and second conduit elements are adjustable longitudinally relative to one another.

51. The apparatus as in claim 41, wherein said first and second conduit elements are adjustable latitudinally relative to one another.

52. The apparatus as in claim 41, wherein said first and second conduit elements are adjustable both longitudinally and latitudinally relative to one another.

* * * * *